US011728114B2

(12) United States Patent
Niebler et al.

(10) Patent No.: US 11,728,114 B2
(45) Date of Patent: Aug. 15, 2023

(54) LOW-VOLTAGE SWITCHING DEVICE INCLUDING AN ELECTROMAGNETIC CONTACT LOAD SUPPORT

(71) Applicant: SIEMENS AKTIENGESELLSCHAFT, Munich (DE)

(72) Inventors: Ludwig Niebler, Laaber (DE); Vadzim Kulinovich, Amberg (DE); Tobias Viehauser, Schwandorf (DE)

(73) Assignee: Siemens Aktiengesellschaft, Munich (DE)

( * ) Notice: Subject to any disclaimer, the term of this patent is extended or adjusted under 35 U.S.C. 154(b) by 957 days.

(21) Appl. No.: 16/332,547

(22) PCT Filed: Jul. 12, 2017

(86) PCT No.: PCT/EP2017/067487
§ 371 (c)(1),
(2) Date: Mar. 12, 2019

(87) PCT Pub. No.: WO2018/050309
PCT Pub. Date: Mar. 22, 2018

(65) Prior Publication Data

US 2021/0287866 A1 Sep. 16, 2021

(30) Foreign Application Priority Data

Sep. 13, 2016 (DE) ..... 10 2016 217 434.7

(51) Int. Cl.
*H01H 50/56* (2006.01)
*H01H 47/22* (2006.01)
*H01H 50/54* (2006.01)

(52) U.S. Cl.
CPC ..... *H01H 50/56* (2013.01); *H01H 47/22* (2013.01); *H01H 50/546* (2013.01)

(58) Field of Classification Search
CPC ..... H01H 50/56; H01H 50/546; H01H 47/22; H01H 1/54; H01H 1/20
(Continued)

(56) References Cited

U.S. PATENT DOCUMENTS 4,467,301 A 8/1984 Goodrich
2015/0022295 A1 1/2015 Takaya
(Continued)

FOREIGN PATENT DOCUMENTS

CN 201741636 U 2/2011
CN 104221117 A 12/2014
(Continued)

OTHER PUBLICATIONS

PCT International Search Report and Written Opinion of International Searching Authority dated Oct. 17, 2017 corresponding to PCT International application No. PCT/EP2017/067487 filed Jul. 12, 2017.
(Continued)

*Primary Examiner* — Thienvu V Tran
*Assistant Examiner* — Sreeya Sreevatsa
(74) *Attorney, Agent, or Firm* — Lempia Summerfield Katz LLC

(57) ABSTRACT

The invention relates to a low-voltage switching device comprising an electromagnetic drive having a coil (1), a fixedly positioned yoke (2), and an armature (3), which is movable relative to the yoke (2), and also comprising a contact system consisting of a fixedly positioned switch piece carrier (4) having a movable switch piece carrier (5) arranged opposite thereto, wherein the movable switch piece carrier (5) is acted upon by a contact load spring (7). The invention is characterized in that a first means for electromagnetic contact load support is positioned on the fixedly positioned switch piece carrier (4).

8 Claims, 4 Drawing Sheets

(58) Field of Classification Search
USPC ..... 361/152
See application file for complete search history.

(56) References Cited

U.S. PATENT DOCUMENTS

| | | | | |
|---|---|---|---|---|
| 2015/0048908 | A1* | 2/2015 | Isozaki | H01H 1/54 335/6 |
| 2018/0053605 | A1* | 2/2018 | Steinbauer | H01H 1/32 |

FOREIGN PATENT DOCUMENTS

| | | | | |
|---|---|---|---|---|
| CN | 105340039 | A | 2/2016 | |
| DE | 3237031 | A1 | 4/1984 | |
| DE | 4216080 | A1 | 11/1993 | |
| DE | 4216080 | A1 * | 11/1993 | H01H 1/54 |
| DE | 10343005 | A1 | 5/2005 | |
| DE | 102009019826 | A1 | 11/2010 | |
| EP | 1264322 | B1 | 5/2007 | |
| EP | 2899731 | A1 | 7/2015 | |
| EP | 2960917 | A1 * | 12/2015 | |
| EP | 2960917 | A1 | 12/2015 | |
| FR | 2793090 | A1 | 11/2000 | |
| FR | 2829869 | A1 | 3/2003 | |
| WO | 0169616 | A1 | 9/2001 | |
| WO | WO-2005034162 | A1 * | 4/2005 | H01H 77/101 |
| WO | 2012017282 | A1 | 2/2012 | |
| WO | WO-2014207111 | A1 * | 12/2014 | H01H 1/54 |

OTHER PUBLICATIONS

Chinese Office Action for Chinese Application No. 201780056010.9 dated Sep. 3, 2019, with English translation.

German Office Action for German Application No. 10 2016 217 434.7 dated Jan. 21, 2019.

Indian Office Action for Indian Patent Application No. 201937009555 dated Jun. 3, 2020.

* cited by examiner

LOW-VOLTAGE SWITCHING DEVICE INCLUDING AN ELECTROMAGNETIC CONTACT LOAD SUPPORT

CROSS REFERENCE TO RELATED APPLICATIONS

This present patent document is a § 371 nationalization of PCT Application Serial Number PCT/EP2017/067487, filed Jul. 12, 2017, designating the United States, which is hereby incorporated in its entirety by reference. This patent document also claims the benefit of DE 102016217434.7, filed on Sep. 13, 2016, which is also hereby incorporated in its entirety by reference.

FIELD

Embodiments relate to a low-voltage switching device including an electromagnetic drive with a coil, a fixedly positioned yoke and an armature that is movable in relation to the yoke.

BACKGROUND

Electrical switching devices are required to switch and carry electrical currents of up to a predetermined magnitude without any disturbance. For this purpose, electrical switching devices include a drive, that closes the contacts with a predetermined contact force, keeps the contacts closed and opens the contacts again.

If current flows over the closed contact points in a switching device, repelling forces of a magnitude that is proportional to the square of the electrical current intensity occur between the contact points. The greater the current that flows over the closed contact points, the greater the repelling forces. The contact pressure springs, the switching mechanism and the electromagnetic drive must be sufficiently dimensioned to correspond to the repelling forces to be expected. This in turn has the effect that, as the rated current increases, the dimensions of the device, the energy consumption for activating the electromagnet and the production costs increase disproportionately.

In this respect, DE 42 16 080 A1 discloses where alongside the portion of a contact spring through which current flows, a ferromagnetic body is arranged a small distance away on the side of the mating contact. The magnetic attraction that the magnetic field of the current flowing over the contact exerts on a ferromagnetic body is used. Depending on the current intensity, the pressure on the contacts is increased.

FR 2 793 090 A1 describes where a U-shaped ferromagnetic element is arranged around the movable switching piece. The flow of current in the movable switching piece includes the effect of inducing in the ferromagnetic element a magnetic flux, by which in turn a contact-closing force is exerted on the movable switching piece.

Both DE 42 16 080 A1 and FR 2 793 090 A1 include the disadvantage that, with the increase in the current flowing through the switching pieces, the electromagnetic contact-closing forces increase greatly, and becomes ever more difficult to separate the contacts when there is a switching-off command.

A solution is described by DE 103 43 005 B4 where at least two U-shaped ferromagnetic yokes that are directed oppositely in the effect of their magnetic forces are provided. A smaller yoke brings about an increase in the contact load. A larger yoke brings about an electrodynamic repulsion of the contacts. The smaller yoke is arranged in the air gap of the larger yoke and closer to the movable switching piece. When there are smaller to medium current intensities, the effect of the smaller yoke predominates, and provides an increase in the contact load. As from a certain current intensity, the circuit of the smaller yoke becomes magnetically saturated. From then on, the effect of the larger yoke comes into effect and causes a repulsion of the contacts.

A further solution is disclosed in FR 2 829 869 A1. A contact switching device between at least one fixedly positioned switching piece and a movable switching arm includes an amplifying magnetic core, that interacts with the movable switching arm, and a compensating magnetic core, that interacts with at least one fixed conductor of the switching device. The amplifying magnetic core and the compensating magnetic core are mounted opposite one another on a movable base. When an electrical current flows in the movable switching arm, an amplifying magnetic flux flows in the amplifying magnetic core and generates a force of attraction between the movable switching arm and the movable base. Acting on the other side of the movable base is the compensating magnetic core, that likewise exerts a force on the movable base, counter to the force effect provided by the amplifying magnetic core. Up to a certain threshold of the electrical current flowing in the movable switching arm, the amplifying force is greater than the compensating force. Beyond the threshold of the current flowing in the movable switching arm, the amplifying force is less than the compensating force. The amplifying magnetic core comes away from the U-shaped magnet part and the magnetic contact load support becomes ineffective.

FR 2 829 869 A1 includes the disadvantage that it requires a complex mechanism and similar to DE 103 43 005 B4, it does not offer any solution to the problem of switching contact erosion.

With switching contact erosion, wear occurs on the switching contacts during operational switching, caused by arc erosion. As a result, the thickness of the contact facing is reduced over the lifetime that includes the consequence that, over the lifetime of an electrical switching device, the movable switching arm gets progressively closer to the fixed switching piece carrier. In order that the force effect of the amplifying magnetic core is retained over the entire lifetime, the relative positioning of the amplifying magnetic core with respect to the switching arm must be readjusted over the lifetime.

SUMMARY AND DESCRIPTION

The scope of the present invention is defined solely by the appended claims and is not affected to any degree by the statements within this summary. The present embodiments may obviate one or more of the drawbacks or limitations in the related art.

Embodiments provide a low-voltage switching device including an electromagnetic contact load support that is easily implemented.

Embodiments provide a low-voltage switching device including an electromagnetic drive with a coil, a fixedly positioned yoke and an armature that is movable in relation to the yoke. Embodiments also include a contact system formed with a fixedly positioned switching piece carrier and a movable switching piece carrier arranged opposite thereto. The movable switching piece carrier is acted upon by a contact load spring. A first electromagnetic contact load support is positioned on the fixedly positioned switching piece carrier.

In an embodiment, two electromagnetic contact load supports may be used. The two electromagnetic contact load supports may be a ferromagnetic plate formed in a U-shaped manner and a spring cup formed in a U-shaped manner. A magnetic flux is respectively induced in both U-shaped ferromagnetic elements bringing about a relatively great electromagnetic excitation even with small currents through the switching piece carrier or through the bridge, so that a relatively great force of attraction is formed between the pole faces.

The pole faces each other are kept relatively small and separated from one another by an air gap. The magnetic circuit quickly becomes saturated, so that the increase in force when there are very high currents is relatively small that is important in order that the switching contacts may still be separated even when there are excessive currents, for example in the case of an overload or short-circuit.

The tilting of the pole faces, for example by 45°, in relation to the contact closing-opening direction provides a greater loss of travel due to contact wear to be compensated. Likewise, tolerances in the relative positioning of the pole faces with respect to the contacts may in this way be compensated. In the switched-on state, the current flows from one terminal to the switching piece carrier, from there to the fixed contact, then over the movable contact to the bridge, from there over the opposite movable contact and fixed contact to the opposite switching piece carrier and then to the opposite terminal. The ferromagnetic U plate, formed in a U-shaped manner, is attached to the switching piece carrier in such a way that the current flowing in the switching piece carrier induces a magnetic flux in the U plate. On the U plate there are pole faces.

Attached to the bridge is a ferromagnetic spring cup with end faces and pole faces. The end faces together with the pole faces form U-shaped portions, that extend around the bridge. The opening of the U is facing the fixed switching piece carrier or the U plate. When there is a flow of current through the bridge, a magnetic flux is respectively induced in the U-shaped portions on the spring cup. The magnetic fluxes in the U plate and the U-shaped portion are of such polarity that a magnetic force of attraction is produced between the pole faces on the U plate and the pole faces on the spring cup, the pole faces arranged in relation to the contact closing-opening direction at an angle of approximately 45°.

Moreover, the arrangements or geometries of the switching piece carrier, bridge, fixedly positioned contact, movable contact, U-shaped portion on the spring cup and U plate are dimensioned such that, in the switched-on state of the low-voltage switching device, an air gap remains between the pole faces. Due to wear at the contacts, the bridge and the spring cup get progressively closer to the switching piece carrier or to the U plate that has the consequence that the air gap between the pole faces become smaller, and consequently the magnetic force of attraction is increased. The distance between the switching piece carrier and the bridge also becomes smaller, and consequently the repelling forces between the bridge and the switching piece carrier become greater.

Embodiments provide that U-shaped ferromagnetic elements are arranged both around the movable bridge and around the fixed switching piece carrier in the form of the spring cup and the U plate, the pole faces of which are directed toward one another in the switched-on state and that electromagnetically attract one another when there is a flow of current through the switching piece carrier and the bridge. The geometries of the ferromagnetic elements are assigned to the contacts in such a way that an air gap remains between the pole faces when the contacts touch. The air gap between the pole faces still exists when the contact material intended for the lifetime of the low-voltage switching device has become worn. The opposing pole faces on the spring cup and on the U plate are not formed perpendicularly to the contact closing-opening direction, but are at an angle of for example 45°. The ferromagnetic elements, including the air gap between the pole faces, are accordingly dimensioned in such a way that the electromagnetic contact load support is less than or equal to the contact load that is applied by way of the contact load spring. Furthermore, the ferromagnetic elements, including the air gap between the pole faces, are dimensioned in such a way that the increase in electromagnetic force on account of the air gap becoming smaller is approximately equal to the increase in the repelling forces between the switching piece carrier and the bridge on account of the decreasing distance.

An embodiment provides a ferromagnetic plate shaped in a U-shaped manner, with two opposing pole faces and a middle region connecting the pole faces.

An embodiment provides that the pole faces of the ferromagnetic plate shaped in a U-shaped manner are formed like wings.

An embodiment provides that the fixedly positioned switching piece carrier is formed in a U-shaped manner, with a first leg and a second leg and a connecting region between the first leg and the second leg. The middle region of the ferromagnetic plate shaped in a U-shaped manner rests on the first leg and the wing-like pole faces are configured in the direction of the second leg, so that the current flowing in the switching piece carrier induces a magnetic flux in the ferromagnetic plate shaped in a U-shaped manner.

An embodiment may provide for electromagnetic contact load support is positioned between the contact load spring and the movable switching piece carrier.

An embodiment may provide where electromagnetic contact load support is a ferromagnetic spring cup formed in a U-shaped manner, with two opposing legs and a middle region connecting the two legs.

An embodiment may include where a cylindrical projection for receiving turns of the contact load spring is formed in the middle region of the ferromagnetic spring cup formed in a U-shaped manner.

An embodiment may include where opposing pole faces are formed in the direction counter to the opposing legs of the spring cup.

An embodiment may provide that the pole faces of the spring cup and the wing-like pole faces of the ferromagnetic plate formed in a U-shaped manner are configured as directed toward one another, with an air gap between the pole faces.

It may also be provided that the low-voltage switching device is a contactor or a circuit breaker or a compact motor branch circuit.

The low-voltage switching device include an electromagnetic drive with a coil, a fixedly positioned yoke and an armature that is movable in relation to the yoke, and also a contact system made up of two fixedly positioned switching piece carriers and a movable switching piece carrier arranged opposite thereto. Both the fixedly positioned switching piece carriers and the movable switching piece carrier respectively have contacts. The contacts of the fixedly positioned switching piece carriers are arranged opposite the contacts of the movable switching piece carrier. Arranged underneath the movable switching piece carrier is a contact load spring. The fixedly positioned switching piece carriers are fixed in place in a housing, the movable switching piece carrier and the contact load spring are arranged in a contact carrier.

The fixedly positioned switching piece carrier may be formed in a U-shaped manner, with a first leg, that may be made longer than the second leg. The legs are connected to one another by way of a connecting region. A first electromagnetic contact load support is positioned on the first leg, for example, on the region of the connecting region. The first electromagnetic contact load support is a ferromagnetic plate shaped in a U-shaped manner, with two opposing pole faces and a middle region connecting the two pole faces. The middle region of the ferromagnetic plate shaped in a U-shaped manner rests on the first leg of the fixedly positioned switching piece carrier in the vicinity of the connecting region. The pole faces may be formed like wings and are directed in the direction of the movable switching piece carrier.

A second electromagnetic contact load support is positioned between the contact load spring and the movable switching piece. The second electromagnetic contact load support is a ferromagnetic spring cup formed in a U-shaped manner, with two opposing legs and a middle region connecting the two legs. A cylindrical projection for receiving turns of the contact load spring may be formed in the middle region of the ferromagnetic spring cup formed in a U-shaped manner. In the direction counter to the opposing legs of the spring cup, opposing pole faces are formed. The pole faces of the spring cup and the wing-like pole faces of the ferromagnetic plate formed in a U-shaped manner are aligned as directed toward one another, with an air gap between the pole faces.

BRIEF DESCRIPTIONS OF THE FIGURES

DETAILED DESCRIPTION

Figure 1:
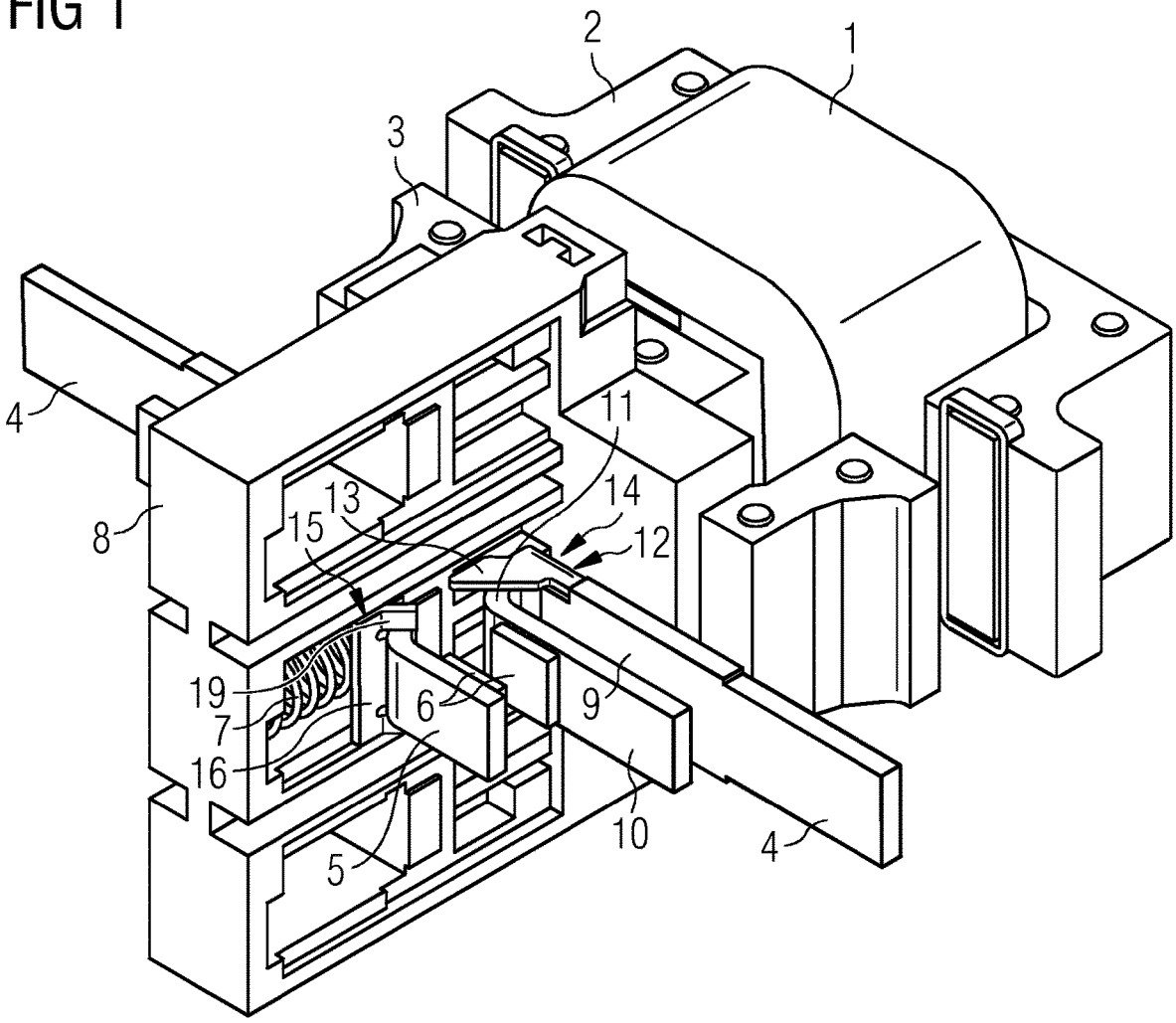
FIG. 1 depicts in a perspective representation components of a low-voltage switching device including an electromagnetic drive and a contact system and also including the electromagnetic contact load support according to an embodiment.

In FIG. 1, a low-voltage switching device including an electromagnetic drive and a contact system is represented. The low-voltage switching device includes an electromagnetic drive with a coil 1, a fixedly positioned yoke 2 and an armature 3 that is movable in relation to the yoke 2 and also a contact system made up of two fixedly positioned switching piece carriers 4 and a movable switching piece carrier 5 arranged opposite thereto. Both the fixedly positioned switching piece carriers 4 and the movable switching piece carrier 5 respectively have contacts 6. The contacts 6 of the fixedly positioned switching piece carriers 4 are arranged opposite the contacts 6 of the movable switching piece carrier 5. Arranged underneath the movable switching piece carrier 5 is a contact load spring 7. The fixedly positioned switching piece carriers 4 are fixed in place in a housing, the movable switching piece carrier 5 and the contact load spring 7 are arranged in a contact carrier 8.

The fixedly positioned switching piece carrier 4 may be formed in a U-shaped manner, with a first leg 9, that may be made longer than the second leg 10. The legs 9, 10 are connected to one another by way of a connecting region 11. A first electromagnetic contact load support is positioned on the first leg 9, for example, in the region of the connecting region 11. This first electromagnetic contact load support is a ferromagnetic plate 12 shaped in a U-shaped manner, with two opposing pole faces 13 and a middle region 14 connecting the two pole faces 13. The middle region 14 of the ferromagnetic plate 12 shaped in a U-shaped manner rests on the first leg 9 of the fixedly positioned switching piece carrier 4 in the vicinity of the connecting region 11. The pole faces 13 may be formed like wings and are directed in the direction of the movable switching piece carrier 5.

A second electromagnetic contact load support is positioned between the contact load spring 7 and the movable switching piece 5. The second electromagnetic contact load support is a ferromagnetic spring cup 15 formed in a U-shaped manner, with two opposing legs 16 and a middle region connecting the two legs 16. A cylindrical projection for receiving turns of the contact load spring 7 is formed in the middle region of the ferromagnetic spring cup 15 formed in a U-shaped manner. Opposing pole faces 19 are formed in the direction counter to the opposing legs 16 of the spring cup 15.

The pole faces 19 of the spring cup 15 and the wing-like pole faces 13 of the ferromagnetic plate 12 formed in a U-shaped manner are directed toward one another, with an air gap between the pole faces 13, 19.

Figure 2:
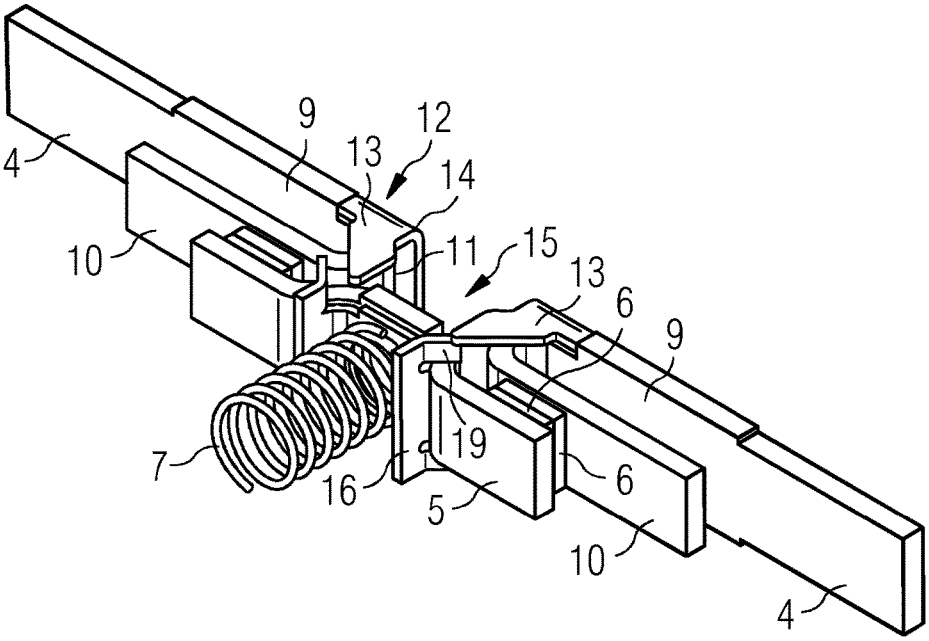
FIG. 2 depicts in a perspective representation an arrangement made up of a fixedly positioned switching piece carrier, a movable switching piece carrier and a contact load spring, including the electromagnetic contact load support according to an embodiment.

FIG. 2 depicts an arrangement including two fixedly positioned switching piece carriers 4, a movable switching piece carrier 5, the contact load spring 7 and the two electromagnetic contact load supports in the form of the plate 12 and the spring cup 15. The middle region 14 of the ferromagnetic plate 12 shaped in a U-shaped manner rests on the first leg 9 of the fixedly positioned switching piece carrier 4 in the vicinity of the connecting region 11. The pole faces 13 may be formed like wings and are directed in the direction of the movable switching piece 5. The second electromagnetic contact load support, the spring cup 15, is arranged between the movable switching piece carrier 5 and the contact load spring 7. Opposing pole faces 19 are formed in the direction counter to the opposing legs 16 of the spring cup 15. The pole faces 19 of the spring cup 15 and the wing-like pole faces 13 of the ferromagnetic plate 12 formed in a U-shaped manner are aligned as directed toward one another, with an air gap between the pole faces 13, 19.

Figure 3:
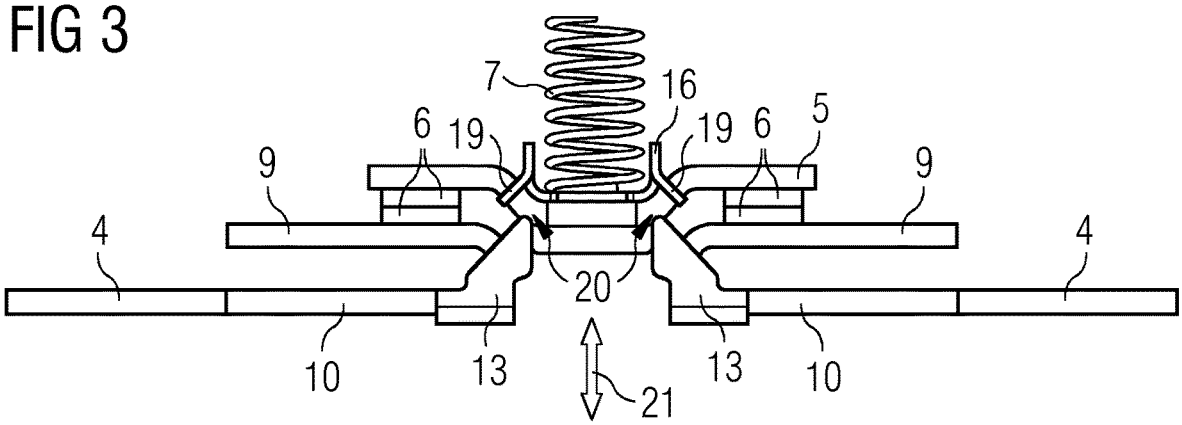
FIG. 3 depicts in a side view the representation as depicted in FIG. 2 according to an embodiment.

The air gap 20 between the pole faces 13, 19 can be seen from FIG. 3. The arrow 21 underneath the fixedly positioned switching piece carrier 4 indicates the contact closing-opening direction.

Figure 4:
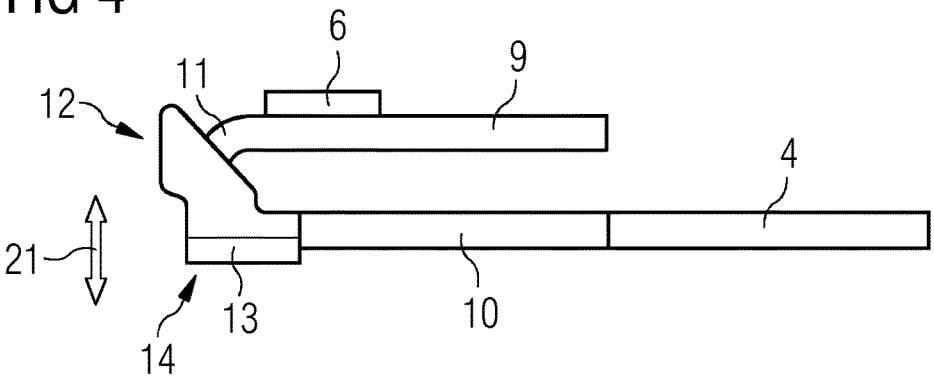
FIG. 4 depicts in a side view an arrangement made up of a fixedly positioned switching piece carrier and a plate for electromagnetic contact load support according to an embodiment.

In FIG. 4, an arrangement including a fixedly positioned switching piece carrier 4 and the plate 12 for electromagnetic contact load support is represented. The middle region 14 of the ferromagnetic plate 12 shaped in a U-shaped manner rests on the first leg 9 of the fixedly positioned switching piece carrier 4 in the vicinity of the connecting region 11. Although the pole faces 13, for example formed like wings, of the plate 12 are directed in the direction of the second leg 10 of the fixedly positioned switching piece carrier 4, the pole faces 13 are arranged laterally offset in a tilting manner with respect to the contact 6. For example, the wing-like pole faces 13 are not directed in the direction of the contact 6, but are formed laterally offset in a tilting manner next to the connecting region 11 of the fixedly positioned switching piece carrier 4.

Figure 5:
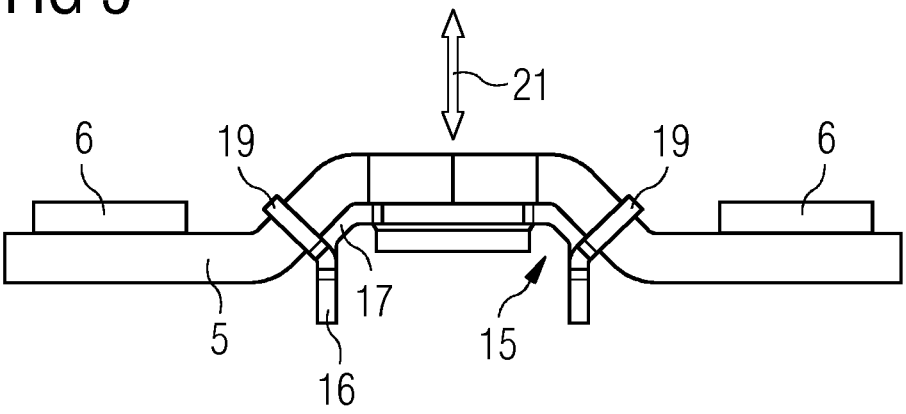
FIG. 5 depicts in a side view an arrangement made up of a movable switching piece carrier and the spring cup according to an embodiment.

In FIG. 5, the second electromagnetic contact load support in the form of the spring cup 15 is represented. The second electromagnetic contact load support is formed in a U-shaped manner and ferromagnetic, with two opposing pole faces 19 and a middle region 17 connecting the two pole faces 19.

Figure 6:
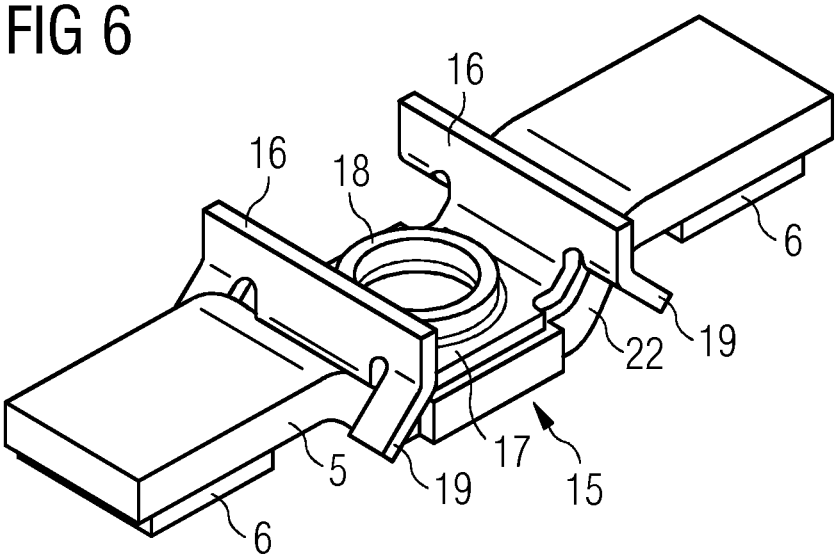
FIG. 6 depicts in a perspective representation an arrangement made up of a movable switching piece carrier and the spring cup for electromagnetic contact load support according to an embodiment.

In FIG. 6, an arrangement made up of a movable switching piece carrier 5 and the second electromagnetic contact load support in the form of a spring cup 15 is represented. The spring cup 15 is formed in a U-shaped manner and ferromagnetic, with two opposing legs 16 and a middle region 17 connecting the two legs 16. The middle region 17 in this case lies against the middle region 22 of the movable switching piece carrier 5. The middle region 17 of the spring cup 15 is positioned on the opposite side from the contacts 6. The legs 16 of the spring cup 15 accordingly are directed away from the contacts 6. Opposing pole faces 19 are formed in the direction counter to the opposing legs 16 of the spring cup 15. The pole faces 19 are directed to the side on which the contacts 6 are arranged.

Figure 7:
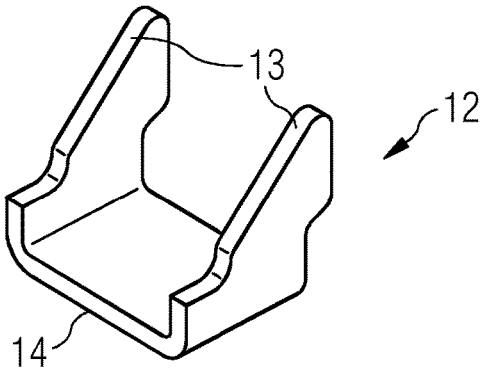
FIG. 7 depicts in a perspective representation the plate for electromagnetic contact load support according to an embodiment.

FIG. 7 depicts the first electromagnetic contact load support in the form of the plate 12 with the pole faces 13 and the middle region 14 connecting the pole faces 13.

Figure 8:
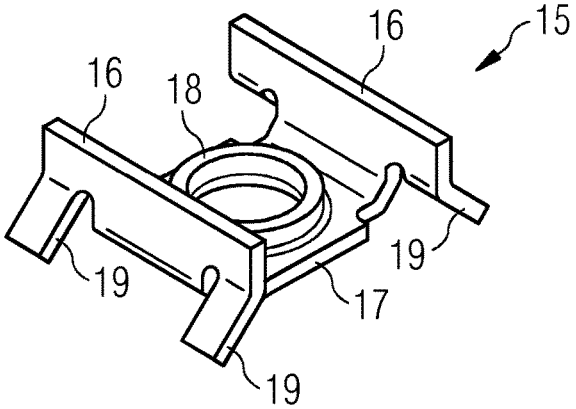
FIG. 8 depicts in a perspective representation a spring cup for electromagnetic contact load support according to an embodiment.

FIG. 8 depicts the second electromagnetic contact load support in the form of the spring cup 15. This second electromagnetic contact load support is formed in a U-shaped manner and ferromagnetic in the form of a spring cup 15, with two opposing legs 16 and a middle region 17 connecting the two legs 16. A cylindrical projection 18 for receiving turns of the contact load spring 7 may be formed in the middle region 17 of the ferromagnetic spring cup 15 formed in a U-shaped manner. Opposing pole faces 19 are formed in the direction counter to the opposing legs 16 of the spring cup 15.

Figure 9:
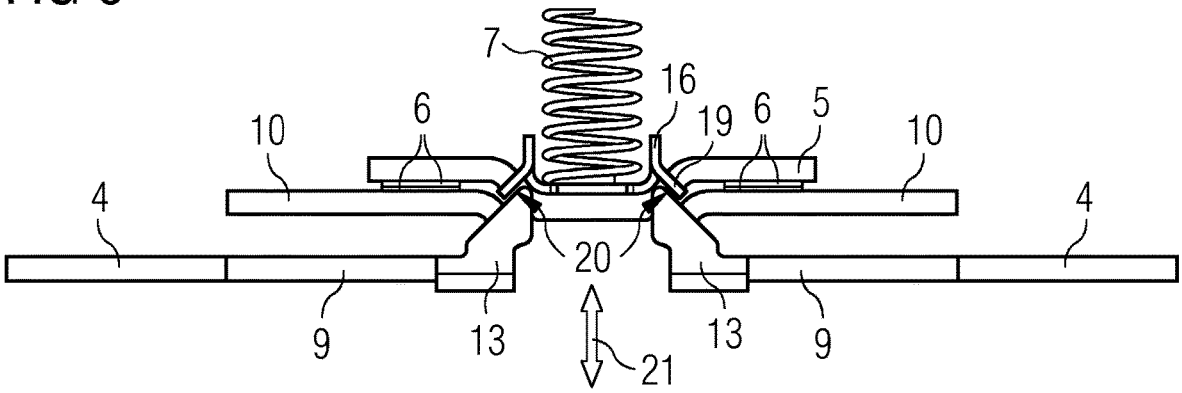
FIG. 9 depicts in a side view an arrangement made up of a fixedly positioned switching piece carrier, a movable switching piece carrier, a contact load spring and the electromagnetic contact load support in the form of a plate and a spring cup with worn contacts, as are encountered at the end of the lifetime according to an embodiment.

FIG. 9 depicts a representation in which the contacts 6 are worn. The air gap 20 between the pole faces 13, 19 of the plate 12 and the spring cup 15 is very small.

The low-voltage switching device is distinguished by the fact that an electromagnetic contact load support in the form of a plate and a spring cup that may also be retrofitted on older devices has been integrated in an easy way.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present invention has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. A low-voltage switching device comprising:

an electromagnetic drive comprising a coil, a fixedly positioned yoke and an armature that is movable in relation to the fixedly positioned yoke; and a contact system comprising a fixedly positioned switching piece carrier and a movable switching piece carrier arranged opposite the fixedly positioned switching piece carrier, wherein the fixedly positioned switching piece carrier and the movable switching piece carrier each include contacts arranged opposite each other, wherein the movable switching piece carrier is acted upon by a contact load spring, wherein a first electromagnetic contact load support comprising a ferromagnetic plate shaped in a U-shaped manner with two first opposing pole faces is positioned on the fixedly positioned switching piece carrier;

wherein a second electromagnetic contact load support comprising a ferromagnetic spring cup formed in a U-shaped manner with two opposing second legs is positioned between the contact load spring and the movable switching piece carrier;

wherein the two opposing second legs of the second electromagnetic contact load support and the two first opposing pole faces of the first electromagnetic contact load support are configured as directed toward one another, with an air gap between the two opposing second legs of the second electromagnetic contact load support and the two first opposing pole faces of the first electromagnetic contact load support when the contacts are open and closed.

2. The low-voltage switching device of claim 1, wherein the two first opposing pole faces of the ferromagnetic plate shaped in a U-shaped manner are formed as wings.

3. The low-voltage switching device of claim 1, wherein the fixedly positioned switching piece carrier is formed in a U-shaped manner, with a first leg and a second leg and a connecting region between the first leg and the second leg, wherein a first middle region of the ferromagnetic plate shaped in a U-shaped manner rests on the first leg and the two opposing first pole faces are configured in the direction of the second leg, so that the current flowing in the switching piece carrier induces a magnetic flux in the ferromagnetic plate shaped in a U-shaped manner.

4. The low-voltage switching device of claim 1, further comprising:

a cylindrical projection configured to receive turns of the contact load spring, the cylindrical projection formed in the middle region of the ferromagnetic spring cup formed in a U-shaped manner.

5. The low-voltage switching device of claim 1, wherein two opposing second pole faces are formed in a direction counter to the two opposing second legs of the ferromagnetic spring cup.

6. The low-voltage switching device of claim 5, wherein the two opposing second pole faces of the spring cup and the two first opposing pole faces of the ferromagnetic plate formed in a U-shaped manner are configured as directed toward one another, with the air gap between the two opposing second pole faces of the ferromagnetic spring cup and the two opposing first pole faces of the ferromagnetic plate.

7. The low-voltage switching device of claim 1, wherein the low-voltage switching device is a contactor or a circuit breaker or a compact motor branch circuit.

8. The low-voltage switching device of claim 1, wherein the first electromagnetic contact load support, the second electromagnetic contact load support, and the air gap are dimensioned in such a way that an increase in electromagnetic force on account of the air gap becoming smaller is approximately equal to an increase in repelling forces between the fixedly positioned switching piece carrier and the movable switching piece carrier on account of a decreasing distance.

* * * * *